US005103765A

United States Patent [19]

Owada et al.

[11] Patent Number: 5,103,765

[45] Date of Patent: Apr. 14, 1992

[54] DEVELOPING DEVICE WITH A TONER LEAKAGE PREVENTION MEMBER

[75] Inventors: Susumu Owada, Hino; Katsuhiro Shukuri, Hachioji; Yutaka Miyasaka, Hachioji; Masayuki Enomoto, Hachioji, all of Japan

[73] Assignee: Konica Corporation, Tokyo, Japan

[21] Appl. No.: 539,152

[22] Filed: Jun. 18, 1990

[30] Foreign Application Priority Data

Jun. 19, 1989 [JP] Japan ..... 1-71917
Jul. 12, 1989 [JP] Japan ..... 1-181311

[51] Int. Cl.[5] ..... G03G 15/08

[52] U.S. Cl. ..... 118/653; 118/658; 355/245; 355/251; 355/260

[58] Field of Search ..... 355/215, 251, 252, 245, 355/253, 259, 260; 118/651, 658, 661, 653

[56] References Cited

U.S. PATENT DOCUMENTS 4,284,702 8/1981 Tabuchi et al. ..... 118/657 X
4,385,829 5/1983 Nakahata et al. ..... 355/253
4,579,442 4/1986 Minejima ..... 355/253
4,583,842 4/1986 Shimono et al. ..... 355/260
4,702,987 10/1987 Fukuchi et al. ..... 118/657 X

*Primary Examiner*—A. T. Grimley
*Assistant Examiner*—J. E. Barlow, Jr.
*Attorney, Agent, or Firm*—Finnegan, Henderson, Farabow, Garrett & Dunner

[57] ABSTRACT

The invention provides an apparatus for developing an electrostatic latent image on a photoreceptor with developer. In the apparatus, there are provided a housing having an open end facing the photoreceptor; a developing device including a sleeve, disposed in the housing in the vicinity of the open end, for supplying developer onto the photoreceptor through the open end; feeder, disposed in the housing at a position further from the open end than the sleeve, for feeding developer to the sleeve; a ridge-like protrusion, provided on a floor of the housing at a position beneath the sleeve, for preventing developer fed by the feeder from passing through between the sleeve and the floor.

3 Claims, 6 Drawing Sheets

DEVELOPING DEVICE WITH A TONER LEAKAGE PREVENTION MEMBER

BACKGROUND OF THE INVENTION

The present invention relates to an apparatus for developing electrostatic latent image, more particularly, to a developing apparatus constituted so that developer in the apparatus is agitated and mixed with toner sufficiently, and fed to a developing roller without being spilled out from the apparatus.

FIG. 5 is a cross-sectional view of major construction of a conventional image forming apparatus.

In the image forming assembly, a photoreceptor drum 101 as image carrier unit is subjected to charge by a charging unit 102. An image of an original is exposed at an exposure position 103 by an exposure optical system to form an electrostatic latent image on a surface of the photoreceptor drum 101. The electrostatic latent image formed on the surface of the photoreceptor drum 101 is developed by a developing unit 110 to form a toner image. The toner image is transferred to a recording paper, or a transfer paper P, by a transfer electrode 104. After the image transfer, the photoreceptor drum 101 is cleaned by a cleaning unit 106. It, then, is subjected to precharging exposure by a light unit 107 to eliminate remaining charge. The above-mentioned process is repeated.

On the other hand, the transfer paper P fed through a paper feeding means 108 and a guide plate 108A and had the toner image transferred, is separated from the photoreceptor drum 101 under the effect of a separating electrode 105. The transfer paper P, then, is carried by a carrying member 109, such as belt, into a fixing unit (not shown) where the transfer paper P is subjected to fixation. After that, it is fed out.

In the electronic photocopying machine such as mentioned above, the said developing unit 110 has a toner supply unit 120 arranged thereon to supply toner T to developer D in the developing unit 110. The image developing unit 110 has a casing 111 that has an opening on the side of the photoreceptor drum 101. The casing 111 has a main stirring member 112, a developing roller 113, a first carrying member 114, and a second carrying member 115 arranged. It also has a brush height limiting plate 116 arranged in vicinity of the developing roller 113 to limit thickness of the developer D on a surface of the developing roller 113.

The casing 111 of the said image developing unit 110 has a toner hopper 122 on an upper side thereof. The toner hopper 122 has a toner supply roller 121 on a lower side thereof. Below the toner supply roller 121 of the toner hopper 122 in the down-stream carrying direction is provided an opening 117 communicated with the first carrying member 114.

With copying repeated, the toner contained in the developer D in the developing unit 110 is consumed. The toner, therefore, must be supplied as consumed to always keep a mixing ratio of the toner to carrier constant; otherwise, copying cannot be done at an optimum density. To achieve this, the developing unit 110 is arrange so that the mixture ratio of the toner to the carrier therein is detected and the toner T is automatically dropped from the hopper 122 to supply the toner as much as consumed.

With revolution of the said developer stirring member 112, the developer D is fed toward an opening A below an image developing area, and the developer D may be scattered and dropped out of the machine. This results in contamination of the photoreceptor drum 101, the image transfer electrode 104 therebelow. For a multi-color image forming machine, the dropped developer D may be mixed into other developing unit placed below, the developing unit.

In order to prevent such problems, an idea of an improved apparatus was proposed by me as in the Tokkaihei No. 1-10608 Opened Gazette. The apparatus has an additional concave developer receiver provided on a bottom of the developing unit 110 below the developing roller 113 and in vicinity of the opening A to prevent the dropping of the developer from the opening A.

However, the developer stirred by the developer stirring member 112 and spilled out the opening A also will be run over the developer receiver to drop out and scatter. These result in a problem that the inside of the apparatus is contaminated, and that a reproduced image is made dirty on its background.

FIG. 6(A) is a cross-sectional view of the apparatus. As shown in the figure, the casing 111 is formed as a channel shaped body which comprises a bottom member 111A and side wall members 111B, with its upper portion 111C made open. The open upper portion is closed by a upper lids 117 and 124.

The casing 111 has the developing roller 113 rotatably supported by the both side wall members 111B. A gap l between an inner surface of the bottom wall member 111A of the casing 111A and an outside surface of the developing roller 113, is kept equal at a certain value on an entire length thereof. If the gap l is too narrow, the developer D adhered on the outside surface of the image developing roller 113 can be clogged at the narrow gap not to be circulated by the developer stirring unit. This will cause the overflow of the developer D out of the apparatus, resulting in scattering outside to contaminate outside the apparatus. If the gap l is too wide, on the other hand, the developer D from the stirring unit of the apparatus will easily pass through the wide gap, resulting in flow out and scattering.

In general, the developing apparatus is made of resin. The casing 111, as shown in FIG. 6(B), will be curved, or deformed, when it is expanded or contracted according to the change of the outside temperature. This makes unequal the gap l between the inner surface of the bottom wall member 111A of the casing 111 and the outside surface of the image developing roller 113. More specifically, a gap l1 around the center becomes narrower than gaps l2 near the side walls 111B. This, as described above, will cause the developer to be clogged at the narrow gap around the center, resulting in flowing out. Clogging of the developer around the center, also, will brake a drive torque of the developing roller 113. This results in problems of uneven rotation of the developing roller 113 or scratches on the surface thereof.

SUMMARY OF THE INVENTION

In view of the above-mentioned problems to be overcome, an object of the present invention is to provide an apparatus for developing electrostatic latent image (hereinafter referred to as the "apparatus") that will provide a quality reproduced image without background contamination in a way that a developer cannot drop down from an opening of the apparatus to prevent an inside of the apparatus from being contaminated.

The apparatus according to the present invention that can achieve the above-mentioned object, has a developing means including a sleeve arranged close to an image carrying body. A developer is contacted to an electrostatic latent image on the image carrying body to visually develop. A casing of the apparatus that houses the developer carrying body has a protrusion on an inner surface of a bottom thereof and in the vicinity of an outside surface of the developer carrying body.

Also, the apparatus according to the present invention is arranged so that a gap between a top of the protrusion and the outside surface of the developer carrying body is made a little wider than a height of the developer formed on the developer carrying body.

Further, the apparatus according to the present invention is arranged so that the protrusion is positioned in the vicinity of a magnet mounted inside the developer carrying body.

Furthermore, the apparatus according to the present invention to achieve the above-mentioned object where the developer carrying body is closely faced with the image carrying body to contact the developer with the surface of the image carrying body to visually develop the image, is characterized in that as for the gap between the top of the protrusion on the inner surface of the bottom of the casing of the apparatus containing the developer carrying body and the outside surface of the developer carrying body, it is made wider on a central section of the inner surface than on side sections near side walls of the casing.

BRIEF DESCRIPTION OF THE DRAWINGS

The features and advantages of the invention will be understood by reference to the following drawings.

In the drawings.

DETAILED DESCRIPTION OF THE PREFERRED EMBODIMENT

Figure 1:
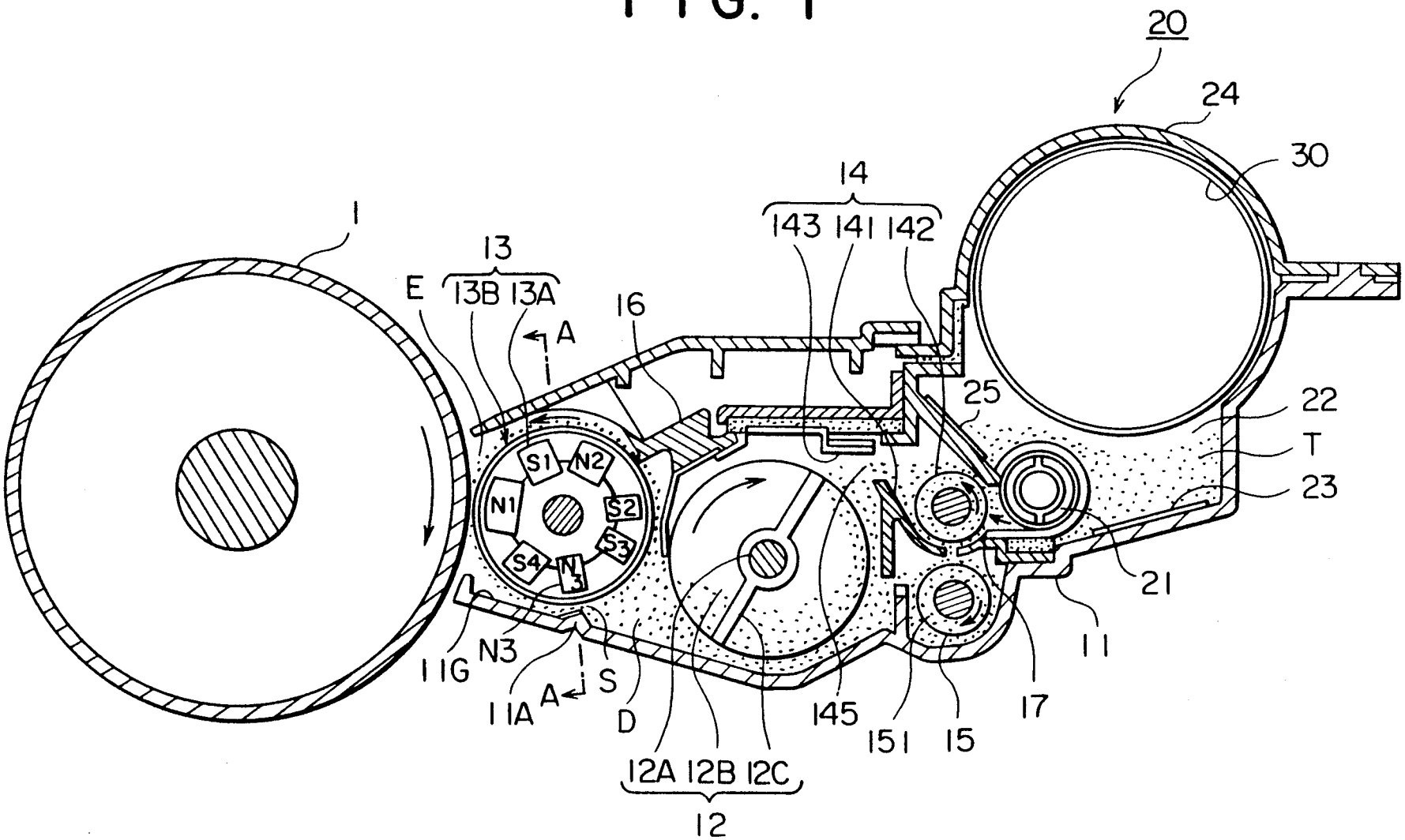
FIG. 1 is a cross-sectional front view of an apparatus for developing electrostatic latent image according to the present invention.
Figure 2:
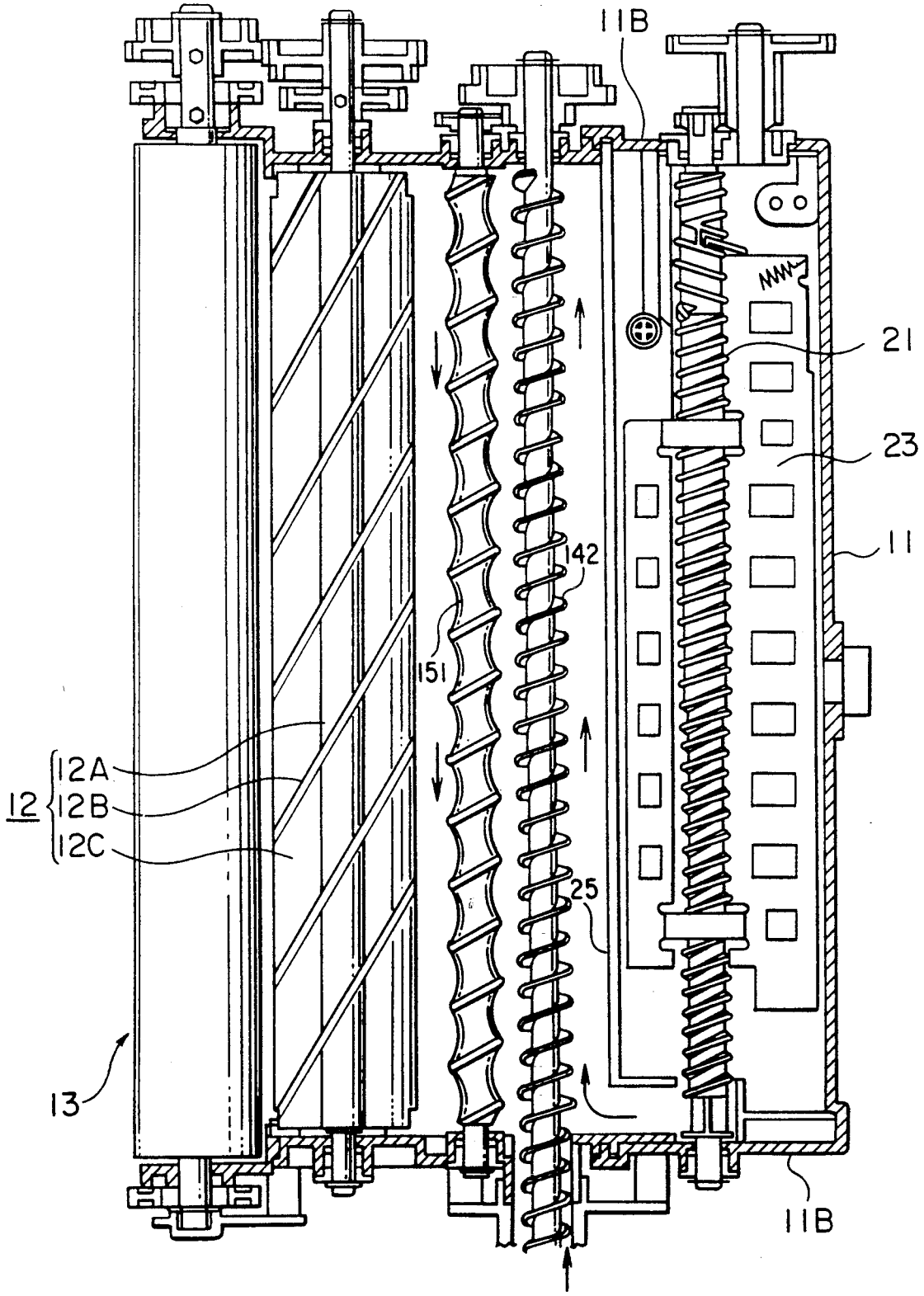
FIG. 2 is a cross-sectional plan view of the apparatus.

Referring now to the figures, an embodiment of the apparatus for developing electrostatic latent image of the present invention will be described below. In the following description, the word "developer" refers to a two-component mixture of toner and carrier, which is different from the toner only. FIG. 1 is a cross-sectional view of the apparatus for developing electrostatic latent image of the present invention. FIG. 2 is a plan view of the apparatus. In the figures, the number 1 indicates a photoreceptor drum, and 11 is a casing for the apparatus 10. The casing has a rotatable developing sleeve 13B with a magnetic roll 13A built in, developer height limiting plate 16 (blade) which can restrict the thickness of the developer D adhered onto the sleeve 13B, a main stirring means 12 for the developer D, a first developer carrying means 14 which can carry the toner or the developer D in the developing apparatus 11 from one end thereof to the other in a lateral direction thereof, and a second developer carrying means 15 which can carry the toner or the developer D in a direction opposite to that of the first developer carrying means 14.

The rotatable developing sleeve 13B, which is arranged in the vicinity of the photoreceptor drum 1, makes the toner in the developer D to be electrostatically attracted and adhered to the surface of the photoreceptor drum 1. Thus the electrostatic latent image is developed as visible toner image.

The main stirring means 12 has a plurality of elliptic stirring blades 12B fixed aslant to a rotating axis 12A thereof. The stirring blades 12B can stir the developer D and toner to mix. At the same time, the stirring blades 12B can level the mixture in the axial direction. The main stirring means 12 also has a plain member 12C arranged along the rotating axis 12A. The plain member 12C can fully stir the developer. The plain member 12C also can scrape up a part of the developer D in the radial direction of the main stirring means 12 to put it into the first developer carrying means 14.

The first developer carrying means 14 comprises a receiving member 141, a carrying screw 142 longitudinally passing the receiving member 141, and a limiting plate 143 provided between the main stirring means 12 and the carrying screw 142 which can restrict amount of the circulating developer D.

The carrying screw 142, as shown in FIG. 2, is a metal spiral screw comprising at least one sheet of thin metal plate wound like coil around and attached to a metal shaft of the first developer carrying means 14. The carrying screw 142 has a narrow screw pitch and a sharp lead slant angle. Thus, its curved surface provides a large carrying force of developer.

The receiving member 141 has a plurality of holes which can drop the developer D on a bottom thereof. Diameters of the holes become larger toward the direction of carrying the developer D. This allows the developer D to be dropped down at an equal rate of drop during carrying of the developer D. The most downstream holes in the carrying direction are made rather large to prevent the developer from being packed against one wall of the apparatus by the carrying screw 142. This allows overflow developer to be dropped well down.

The receiving member 141 also has a partition wall 71C formed, over which the developer scraped up by the main carrying means 12 can be put down to the carrying screw 142. The partition wall 71C form a developer inlet 145 together with the limiting plate 143.

There are an inlet for supplying fresh toner T and another inlet for entering the cycled toner to the upstream side of the developer carried by the carrying screw 142.

The casing 11 of the apparatus 10 is attached to a toner supply unit 20 on the upper right thereof which can supply fresh toner T into the casing 11.

The toner supply unit 20 comprises a lid 24 for covering a toner supply container 30 which can be connected to the casing 11, a toner supply roller 21 having a spiral screw, a hopper 22 for containing the toner T, a vibration plate 23, and a partition plate 25.

A recess of the casing 11 and receiving member 141 form a room. In the room a carrying screw 151 which is the second developer carrying means 15 is provided. The carrying screw 151 is made of resin, and has a wide screw pitch and a low slant angle. Thus, the carrying screw 151 provides features of a little toner carrying force in an axial direction thereof and a greater toner carrying force in a direction perpendicular to an axis thereof.

The above-mentioned developing sleeve 13B is a thin-wall cylinder of stainless steel, an outside surface of which is made rough by sandblast treatment. It, as shown by arrow in FIG. 1, can be revolved counterclockwise at a speed two to three times the image carrier drum 1. When an image is developed in an developing area E, the developing sleeve 13B is set in place so that an outside surface thereof can be kept around 0.5 mm away from a outside surface of the image carrier drum 1.

On the magnetic roll 13A arranged inside the developing sleeve 13B are arranged in place a main magnet N1 involved in development a north pole of which is directed outward, a plurality of sub-magnets S1, S2, S3 and S4 for carrying the developer D south poles of which are directed outward, a submagnet N2 between the sub-magnets S1 and S2, and a sub-magnet N3 between the sub-magnets S1 and S2.

The above-mentioned developer height limiting plate 16 can limit to a required amount, or to a desired thickness, the developer D that is carried as adhered to the outside surface of the developing sleeve 13B by the sub-magnets S1 through S4, N2 and N3 of the magnetic roll 13A. The developer can be raised up in the developing area E by the mentioned main magnet N1. This process allows supply of the amount of the toner T required to adhere for the electrostatic latent image on the image carrier drum 1.

In the apparatus according to the present invention, a protruded portion 11A is provided in the vicinity of the outside surface of the developing sleeve 13B on the inner surface of the bottom of the casing 11. The protruded portion 11A extends almost entire width of the casing 11 in the crosssectional view of FIG. 1.

It should be noted that the casing 11 is formed of synthetic resin, and that the protruded portion 11A is formed and integrated with that casing.

A gap S between an edge of the protruded portion 11A and the outside surface of the developing sleeve 13B is set a little greater than the brush height of the developer D on the developing sleeve 13B.

According to the preferred embodiment of the present invention, the mentioned protruded portion 11A is provided in a position in the vicinity of one of the sub-magnets arranged inside the developing sleeve 13B, for example, near the submagnet N3. The position selected is from a reason that the sub-magnet provides a density of magnetic flux so high that the developer can be strongly adhered to the outside surface of the developing sleeve 13B by the magnetic force there.

The developer D contained in the recess of the casing 11 can be conveyed by the outside surface of the rotating developing sleeve 13B by the sub-magnets of the magnetic roll 13A as attracted thereby and adhered thereto. The developer D limited to a desired thickness by the limiting plate 16, is carried to the developing area, and is contacted with the electrostatic latent image on the image carrying drum 1 in the area. After development the developer is adhered by the sub-magnet S4 to the rotating developing sleeve 13B. Then, it is carried through a developer receiver 11G and the gap S formed with the sub-magnet N3 and the protruded portion 11A.

In the gap S, the developer layer on the developing sleeve 13B is strongly adhered by the sub-magnet N3 to the outside surface thereof. It should be noted that since the gap S is as narrow as or a little wider than the thickness of the developer layer, it can restrict the developer to pass.

Restriction effect at the gap S by the developer layer can shut out the blowing off of the developer at the opening caused by the revolving main stirring means 12 in the casing 11 of the apparatus. This prevents the developer from leaking out to the developer receiver 11G.

As explained above, the apparatus according to the present invention has a protruded portion to form a narrow gap on the bottom of the casing of the apparatus near the opening at the developing sleeve and in the vicinity of a pole of one sub-magnet of the developing sleeve. Since the narrow gap can close with the developer layer on the developing sleeve, it can prevent the developer stirred in the casing from leaking out. That is, the narrow gap prevents scattering and dropping of the developer. This is effective in keeping the inside of the apparatus clean. Also, it makes possible to obtain a high quality duplicate without dirty background.

Figure 3:
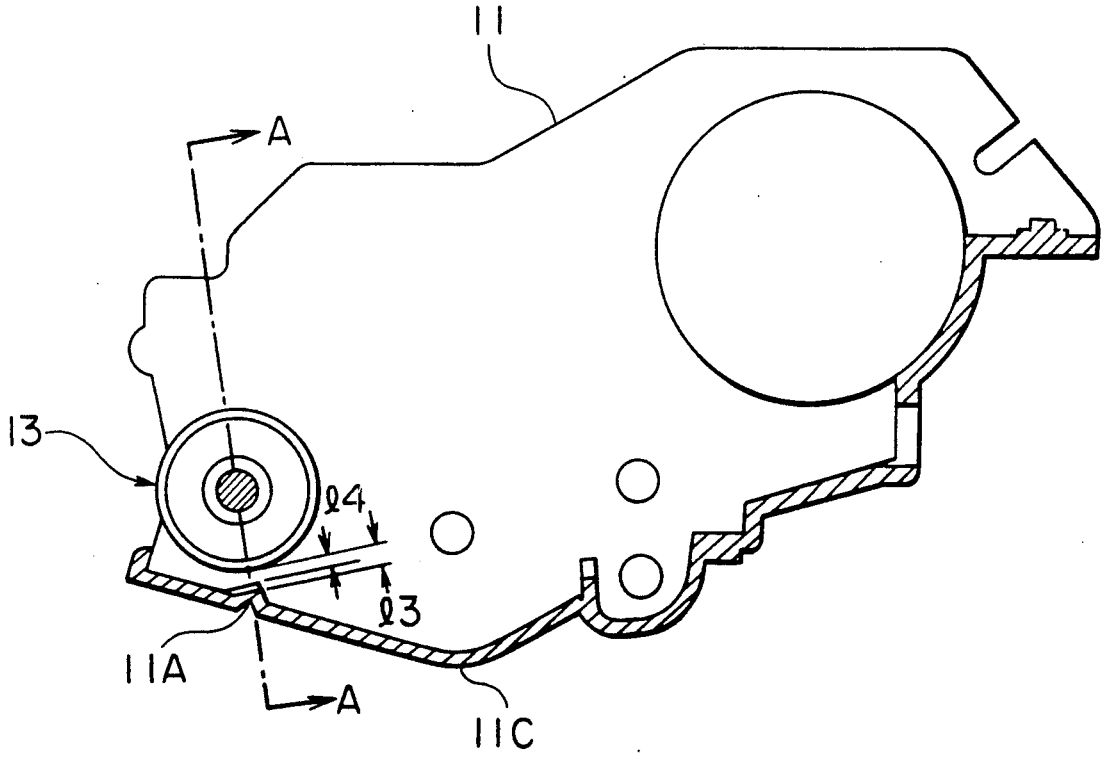
FIG. 3 is a cross-sectional view of a central section of a main body of the apparatus.
Figure 4:
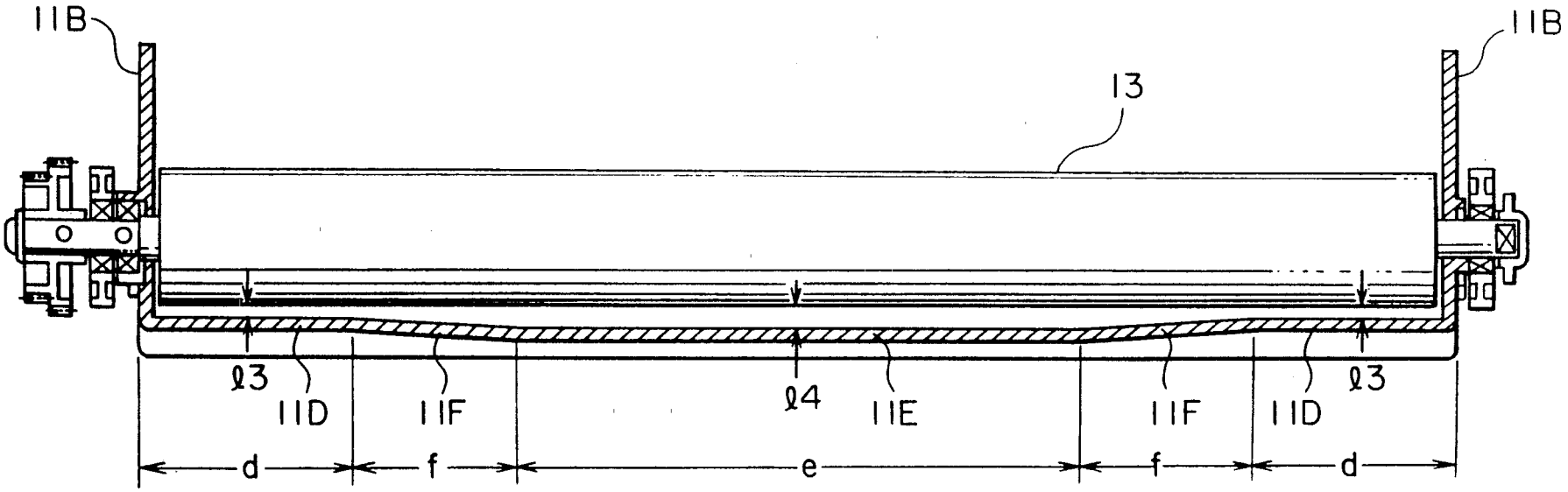
FIG. 4 is a cross-sectional view taken from plane A—A of the apparatus.
Figure 5:
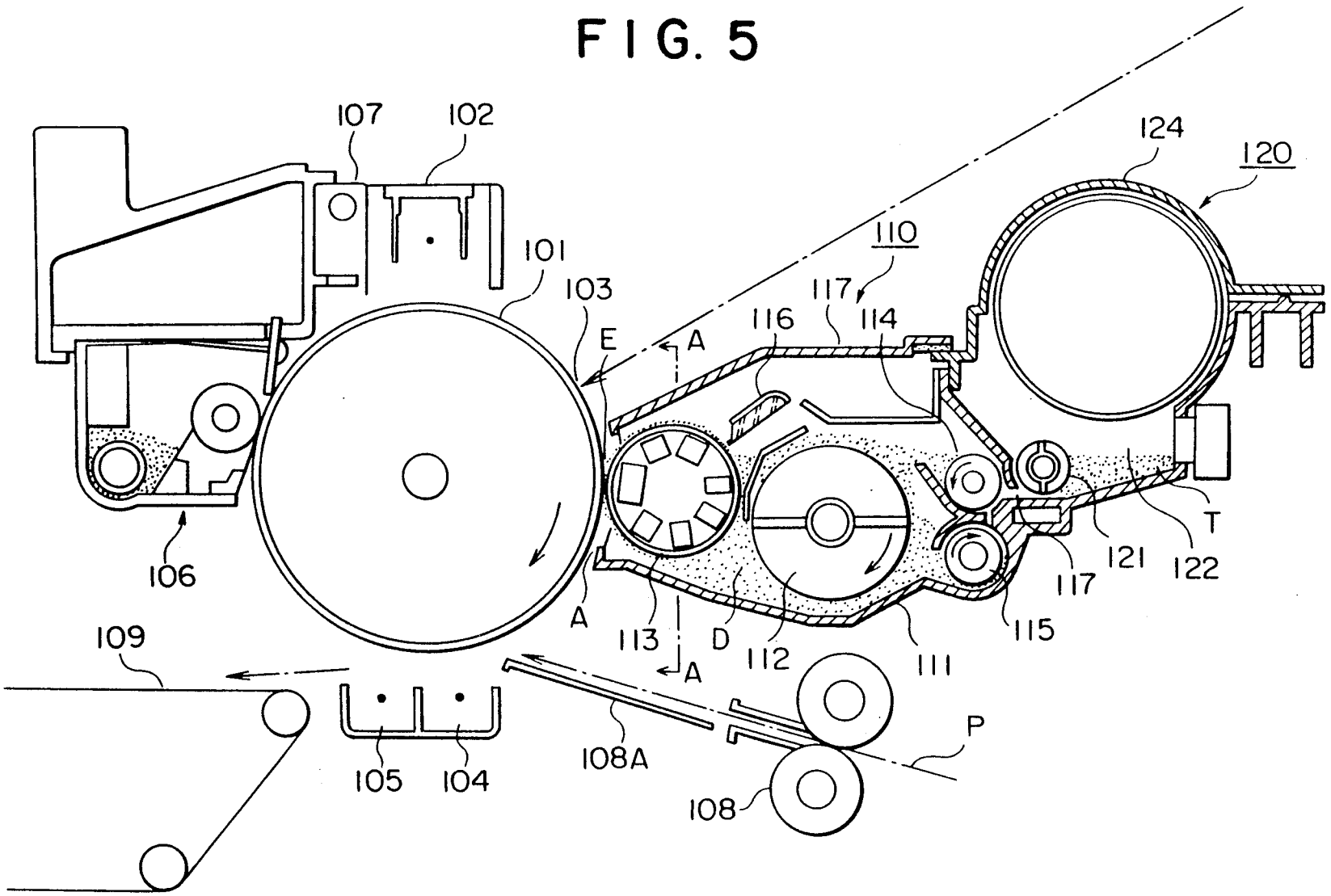
FIG. 5 is a cross-sectional view of a conventional apparatus for developing electrostatic latent image.

Another preferred variation of the above-mentioned embodiment of the apparatus according to the present invention is described below. FIG. 3 shows a cross-sectional view of a center section of the casing 11 and the developing roller 13. FIG. 4 shows a cross-sectional view taken from plane A—A of FIG. 3.

As shown in FIG. 4, the gap between the protruded portion 11A of the inside bottom wall of the casing 11 and the developing roller 13 is not uniform, but it is made wider around a center section than sections near side walls 11B of the casing 11.

More specifically, a gap l3 between an inner surface 11D of the protruded portion 11A and the outside surface of the developing roller 13 is made parallel or slightly slanted in an axial section d near the side walls 11B each. The gap l3 is 1.6 to 2.0 mm, which is determined a little wider than the height of the developer formed on the outside surface of the developing roller 13 in the vicinity of the protruded portion 11A.

A gap l4 between a central inner surface 11E of the protruded portion 11A and the outside surface of the developing roller 13 in axial section e is determined 2.4 to 2.8 mm. Difference of the gap l4 at the central section and the gap l3 at the side sections is 0.4 to 1.2 mm.

The inside wall portions 11D and 11E are gently connected with slant inside walls 11F respectively.

The protruded portion 11A is provided in close vicinity to any one of the sub-magnets arranged inside the mentioned developing sleeve 13B, for example, the sub-magnet N3 shown. The position selected is due to a fact that the sub-magnet provides a density of magnetic flux so high that the developer can be strongly adhered to the outside surface of the developing sleeve 13B by the magnetic force there.

The casing is formed of the material that is composed mainly of denatured polyphenylene-ether resin (denatured PPE), and that has glass fiber of 20% by weight mixed therewith to reinforce. Such a casing features high strength and relatively small thermal deformation.

Figure 6A:
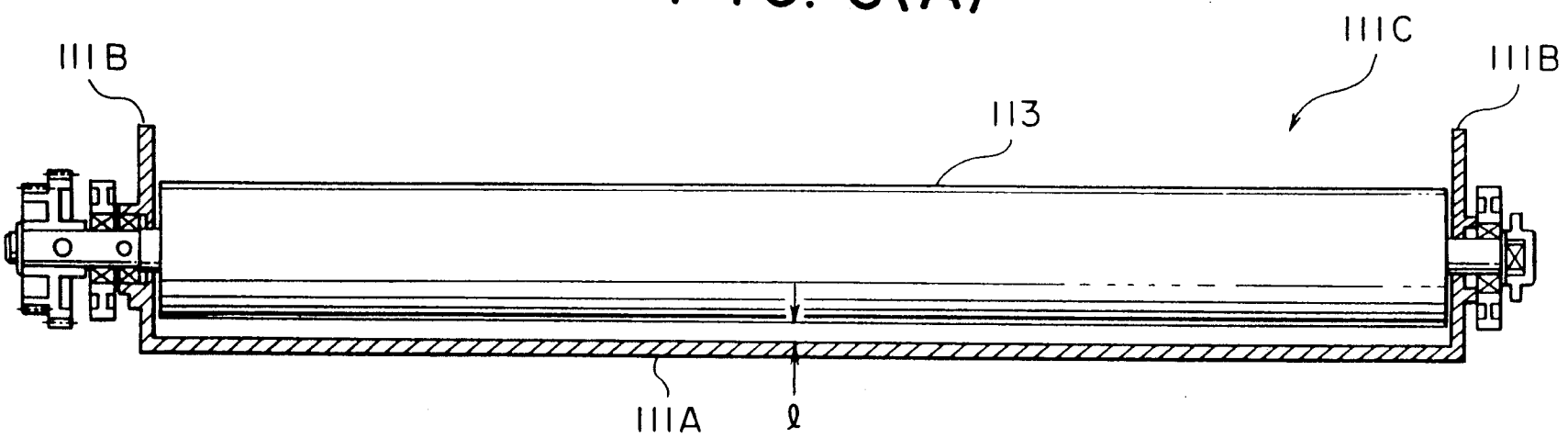
FIG. 6(A) and 6(B) are cross-sectional views taken from plane A—A of the conventional apparatus.
Figure 6B:
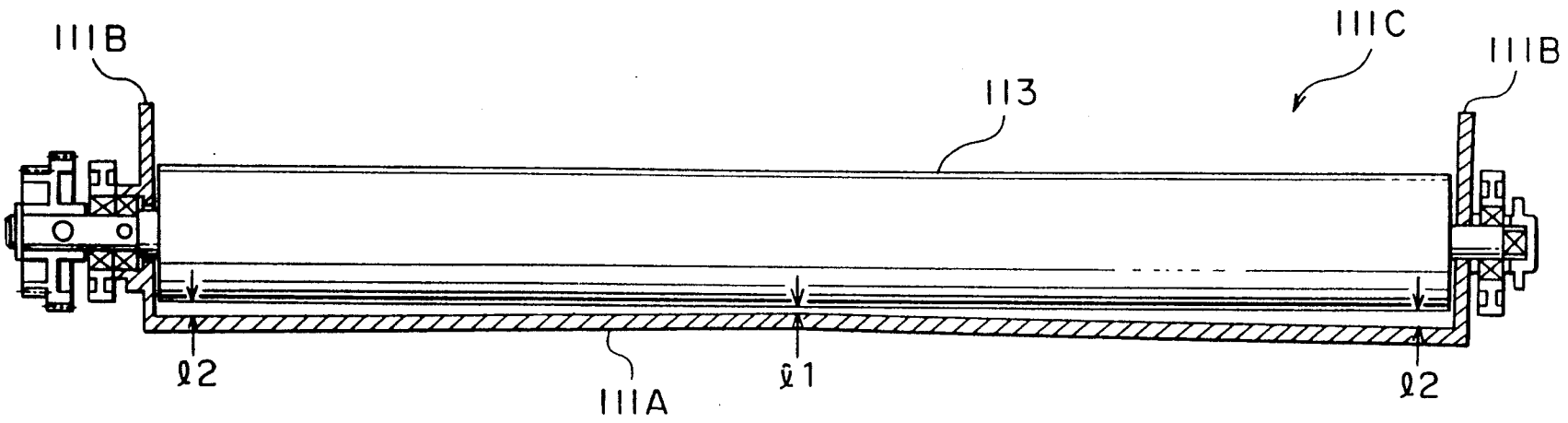

In general use, the mentioned casing 11 may increase to room temperature plus 55 degrees Celsius, that is, to 80 degrees Celsius. With this temperature rise, the casing 11, as shown in FIG. 6(B), will be deformed to make a gap l1 narrower. As shown in FIG. 4, however, of the casing 11 of the apparatus according to the present invention, the protruded portion which is particularly needed to have a precise gap to the outside surface of the developing roller 13, is made wider on the central section than that of the side sections. Thus, even if the inside walls 11E and 11F of the protruded portion 11A is deformed by the maximum temperature rise, the gap on the central section can be kept within a required limit, that is, it becomes equal to or approximate to the gap l3 at the side sections. This means that the inner surface at the central section of the protruded portion will not make lesser gap to the outside surface of the developing roller 13 than predetermined, thereby being free of abnormal closing to it.

The developer D contained in recess of the casing 11 is attracted by the mentioned magnetic roll 13A to adhere to the outside surface of the rotating developing sleeve 13B. The developer D is carried by the developing sleeve 13B as mounted thereon. The developer D, then, is limited its thicknes to a desired thickness by the limiting plate 16, and is carried to the developing area E. It is contacted with the electrostatic latent image on the image carrier drum 1 in the area. The developer which lost some toner can be adhered by the sub-magnet S4 in the rotating developing sleeve 13B. Then, it is carried through a developer receiver 11G and the gaps l3 and l4 in which the sub-magnet N3 is faced to the protruded portion 11A. In the gaps, the developer layer on the developing sleeve 13B is strongly adhered by the sub-magnet N3 to the outside surface thereof. It should be noted that since the gaps are as narrow as or a little wider than the thickness of the developer layer, it can restrict the developer to pass.

By the restriction effect of the protruded portion 11A, the developing sleeve 13B, and the developer layer, the spilling of the developer caused by the revolving main stirring means 12 in the casing 11 of the apparatus from the opening of the gap S to the developer receiver 11G can be prevented.

As explained above, the apparatus according to the present invention has a protruded portion to form a gap needed on the bottom of the casing of the apparatus near the opening on the developing sleeve and in the vicinity of the developing sleeve. The gap is made wider on the central section of the protruded portion than on the both side sections.

The gap can be kept within a limit even if the casing is deformed with its operating temperature increasing to the maximum one.

Since the gap can always close the developer layer on the developing sleeve irrespective of temperature increase, it can prevent the developer stirred in the casing from leaking out. That is, the narrow gap prevents scattering and dropping of the developer. This is effective in keeping the inside of the apparatus clean. Also, it makes possible to obtain a high quality duplicate without dirty background.

What is claimed is:

1. An apparatus for developing an electrostatic latent image on an image carrying means, comprising:

a housing having an open end facing said image carrying means;

developing means, including a sleeve disposed in said housing in the vicinity of said open end, for supplying developer onto said image carrying means through said open end;

feeding means, disposed in said housing at a position away from said open end that said sleeve, for feeding developer to said sleeve; and a ridge-like protrusion provided on a floor of said housing in a position beneath said sleeve, for preventing developer fed by said feeding means from passing between said sleeve and said floor, wherein said ridge-like protrusion is closer to the sleeve at its end portions than at its central portion.

2. The apparatus of claim 1, wherein a gap between said developing sleeve and said ridge-like protrusion in the vicinity of end portion of said ridge-like protrusion is 1.6 to 2.0 mm.

3. The apparatus of claim 1, wherein a gap between said developing sleeve and said ridge-like protrusion in the vicinity of central portion of said ridge-like protrusion is 2.4 to 2.8 mm.

* * * * *